US009616272B1

(12) United States Patent
Bennett

(10) Patent No.: US 9,616,272 B1
(45) Date of Patent: Apr. 11, 2017

(54) ADJUSTABLE WEIGHT EXERCISE BALL

(71) Applicant: Kristine Allyn Becker Bennett, Tucson, AZ (US)

(72) Inventor: Kristine Allyn Becker Bennett, Tucson, AZ (US)

( * ) Notice: Subject to any disclaimer, the term of this patent is extended or adjusted under 35 U.S.C. 154(b) by 45 days.

(21) Appl. No.: 14/679,027

(22) Filed: Apr. 6, 2015

Related U.S. Application Data

(60) Provisional application No. 61/978,665, filed on Apr. 11, 2014.

(51) Int. Cl.

| | |
|---|---|
| ***A63B 21/06*** | (2006.01) |
| ***A63B 23/16*** | (2006.01) |
| ***A63B 21/00*** | (2006.01) |
| ***A63B 71/00*** | (2006.01) |
| ***A63B 21/075*** | (2006.01) |
| *A63B 37/12* | (2006.01) |

(52) U.S. Cl.
CPC ..... *A63B 21/075* (2013.01); *A63B 21/0603* (2013.01); *A45F 2003/142* (2013.01);
(Continued)

(58) Field of Classification Search
CPC . A63B 21/00; A63B 21/004; A63B 21/00043; A63B 21/002; A63B 21/0023; A63B 21/02; A63B 21/028; A63B 21/0407; A63B 21/0414; A63B 21/0435; A63B 21/0442; A63B 21/06; A63B 21/0601; A63B 21/0602; A63B 21/0603; A63B 21/0604; A63B 21/0606; A63B 21/0607; A63B 21/0608; A63B 21/0609; A63B 21/075; A63B 21/22; A63B 21/4023; A63B 21/4033; A63B 21/4041; A63B 37/02; A63B 37/06; A63B 37/08; A63B 37/12; A63B 2037/065; A63B 2037/082; A63B 2037/085; A63B 39/00; A63B 39/06; A63B 43/02; A63B 21/00065; A63B 21/0419; A63B 21/4035; A63B 21/4043; A63B 23/0211; A63B 41/02; A63B 41/04;
(Continued)

(56) References Cited

U.S. PATENT DOCUMENTS 3,069,162 A * 12/1962 Samuel ..... A63H 1/32 273/451
5,242,348 A * 9/1993 Bates ..... A63B 21/0004 482/105

(Continued)

*Primary Examiner* — Joshua Lee
(74) *Attorney, Agent, or Firm* — Invention To Patent Services; Alex Hobson

(57) ABSTRACT

An adjustable weight exercise ball and particularly a soft exercise ball has one or more handles that are formed from a strap extending around the perimeter of the exercise ball. The exercise ball may have no rigid or hard materials, such as no more than 50 shore A hardness. The generally spherical exercise ball may have a substantially smooth outer surface with no significant protrusions from the surface. In addition, an adjustable weight exercise ball has a single aperture for the insertion of weights through an access slot to a pouch configured within the interior volume of the ball. The weights inserted into the exercise ball may be conformable weights that mold to the interior pouch area within the exercise ball. The interior material of the exercise ball may comprise an elastomeric material that compresses and seals the access slot closed after weights are inserted therein.

19 Claims, 9 Drawing Sheets

(51) Int. Cl.

| | |
|---|---|
| *A63B 41/08* | (2006.01) |
| *A63B 47/00* | (2006.01) |
| *A63B 43/02* | (2006.01) |
| *A45F 3/14* | (2006.01) |

(52) U.S. Cl.
CPC ..... *A63B 21/0004* (2013.01); *A63B 21/00043* (2013.01); *A63B 21/06* (2013.01); *A63B 21/4035* (2015.10); *A63B 21/4043* (2015.10); *A63B 37/12* (2013.01); *A63B 41/08* (2013.01); *A63B 43/02* (2013.01); *A63B 47/007* (2013.01)

(58) Field of Classification Search
CPC ..... A63B 41/08; A63B 41/085; A63B 41/10; A63B 2041/005; A63B 47/007; A63B 21/0605; A45F 2003/142
USPC ..... 482/93; 224/919
See application file for complete search history.

(56) References Cited

U.S. PATENT DOCUMENTS 5,282,777 A * 2/1994 Myers ..... A63B 21/0004 473/576
5,735,776 A * 4/1998 Swezey ..... A63B 21/0085 473/596
5,810,700 A * 9/1998 Orcutt ..... A63B 21/0552 482/121
6,652,421 B1 * 11/2003 Chen ..... A63B 21/0603 482/49
6,991,553 B2 * 1/2006 Park ..... A63B 21/0608 473/219
7,141,012 B2 * 11/2006 Lin ..... A63B 21/0004 482/121
7,326,122 B2 * 2/2008 Park ..... A63B 21/06 473/256
8,911,334 B1 * 12/2014 Cotter ..... A63B 43/02 482/105
2004/0048724 A1 * 3/2004 Wang ..... A63B 65/06 482/109
2011/0251029 A1 * 10/2011 Verheem ..... A63B 21/0004 482/110
2012/0149536 A1 * 6/2012 Trimble ..... A63B 21/00065 482/93
2012/0184418 A1 * 7/2012 Wilson ..... A63B 21/00043 482/112
2013/0085045 A1 * 4/2013 Chavez ..... A63B 21/0442 482/93
2015/0182777 A1 * 7/2015 Rarity, IV ..... A63B 21/0602 482/93

* cited by examiner

ADJUSTABLE WEIGHT EXERCISE BALL

CROSS REFERENCE TO RELATED APPLICATIONS

This application claims the benefit of U.S. provisional patent application No. 61/978,665, entitled Adjustable Weight Exercise Ball, and filed on Apr. 11, 2014; the entirety of which is incorporated by reference herein.

BACKGROUND OF THE INVENTION

Field of the Invention

The present invention relates to an adjustable weight exercise ball and particularly a soft exercise ball.

Background

Exercising with rigid weights poses certain risks of injury from impact with the weight, such as from dropping the weights. Dumbbells and kettle bells, for example, are made of metal or hard, non-conformable materials. Many people are now using weighted exercise devices during aerobic activities and sometimes in group situations. Lifting, swinging or twisting with a weighted exercises device, such as a dumbbell or kettle bell, may result in hitting a nearby person.

There is a need for a soft and conformable exercise device that can be used for a variety of exercises and that can be adjusted in weight.

SUMMARY OF THE INVENTION

The invention is directed to an adjustable weight exercise ball and particularly a soft exercise ball. In a preferred embodiment, the exercise ball comprises no rigid or hard materials, such as no more than 50 shore A hardness, for example. The generally spherical exercise ball, as described herein, may have a substantially smooth outer surface and one or more handles. In addition, the adjustable weight exercise ball comprises a single aperture extending from the exterior of the ball to a pouch configured within the interior volume of the ball for the insertion of weights.

The interior volume of the adjustable weight exercise ball may comprise an interior material that is compressible to allow any number of weights to be inserted into the pouch, whereby the compressible material will deform to accommodate the weights. In a preferred embodiment, the interior material comprises an elastomeric or elastic material that will substantially regain a shape after being deformed. An elastic interior material will allow any number of weights to be inserted into the interior pouch and retain them while preventing them from jostling about within the pouch. A pouch may be squeezed substantially closed by an elastic interior material when no weights are inserted therein. An exemplary interior material is preferably soft, less than 50 shore A durometer, compressible and even more preferable elastomeric. The interior material may have a shore A hardness of no more than about 20 shore A, no more than about 30 shore A, no more than about 40 shore A, no more than about 50 shore A and any range between and including the Shore A values provided. A suitable type of interior material is foam, such as a polyurethane foam, including high density urethane foam, and may have a density of no more than about 1 g/cm$^3$ no more than about 0.8 g/cc, no more than about 0.5 g/cc, and any range between and including the densities provided.

An adjustable weight exercise ball, as described herein, may be any suitable size and have an outer diameter greater than about 30 cm, greater than about 60 cm, greater than about 90 cm and any range between and including the diameters provided. An adjustable weight exercise ball may be substantially spherical and have no protrusion from the surface of the exterior of the ball more than 5% of the diameter of the ball.

An adjustable weight exercise ball may have any number of straps extending around the perimeter of the ball including one, two, three, or four or more. A strap extending completely around the perimeter of the exercise ball is defined herein as a continuous strap, and will provide more durable attachment of the strap and handle than a single discrete handle attached to the ball. A continuous strap may be a contiguous strap that is a ring or a piece of material formed into a ring with no end. A contiguous strap may further provide additional strength and durability. A strap may be attached to the adjustable weight exercise ball on the exterior and/or interior of the outer cover and may extend through a sleeve or a plurality of sleeves between handles. A strap may extend around the largest portion of the ball or may centrally located about the ball and extend around the perimeter of the ball. A ball may have two straps that are configured perpendicular to each other. In one embodiment, an adjustable weight exercise ball comprises a first strap and a second strap, wherein the first strap is configured perpendicularly to the second strap. For example, the straps may be configured like two hoops inserted perpendicularly within each other. A strap may have any suitable width including greater than about 2.5 cm, greater than about 5.0 cm, greater than about 7.5 cm, greater than about 4.0 cm and any range between and including the strap widths provided. A strap may be made out of any suitable material, including leather, vinyl, plastic, fabric, and the like. A strap may have a substantially uniform width around the perimeter of the ball or may vary in width or thickness. A handle portion of a strap may be narrower than a recessed or attached portion within a sleeve for example. A handle formed from a strap may be soft and conformable and have a shore A of less than 50 and be substantially flush with the outer surface of the exercise ball. The exercise ball may have a substantially smooth outer surface having no protrusion from the outer surface greater than 5% of the diameter of the ball. An exercise ball of the present invention may be soft and have a smooth outer surface with no prominent protrusions, thereby reducing the likelihood of an injury during use.

A handle is a portion of a strap that is exposed on the outside of the exercise ball and configured for grasping or holding by a person. A strap that extends around a perimeter of an adjustable weight exercise ball may have one, two, three, four or more handle portions, or exposed portions along the length of the strap. In a preferred embodiment, a strap has a first handle that this configured on an opposing side to a second handle, or about 180 degrees offset. A strap may be configured within the interior of the outer cover except where it extends out from the interior to form handles. A strap may form a hoop that is attached to the outer cover of the exercise ball and thereby be strong and durable. A strap that extends within and is attached to the outer cover is particularly strong, in that it cannot be pulled off from the outer cover.

The outer covering of the adjustable weight exercise ball may be any suitable type of material, such as leather, vinyl, fabric, plastic and the like. An outer cover may consist essentially of a single piece of material that is sewn or otherwise configured into a sphere. An outer cover comprises an aperture for the insertion of weights into the interior pouch. The aperture may be any suitable length such as no more than about 7 cm, no more than about 10 cm, no more than about 15 cm, no more than about 20 cm and any range between and including the aperture lengths provided. An aperture may be open, or may comprise a flap that extends over the aperture. An aperture may also comprise an aperture closure feature such as a zipper or hook and loop fastener, whereby the aperture can be closed. A flap may be configured along an aperture and comprise a hook and loop fastener that is configured to attach to a hook and loop fastener on the exterior of the exercise ball, for example. In another embodiment, a zipper is configured to attach a first side of the aperture to a second side of the aperture. In still another embodiment, buttons or snaps may be used to secure and close the aperture.

An access slot couples the aperture with an interior pouch for retaining weights. The pouch may be substantially centered within the adjustable weight exercise ball, whereby the interior material substantially surrounds the pouch and only a single access slot extends to the exterior. The interior pouch may have any suitable size and may comprise a void in the interior material, wherein the interior material surrounds the pouch when the access slot is closed. An interior pouch may have a volume that is no more than about 40%, no more than about 30%, no more than 20% or no more than 10% of the exercise ball volume as defined by the exercise ball diameter. In addition, the access slot may be substantially closed, have no open space or dimension, other than when it is in an open configuration to insert or remove weights. A compressible or elastomeric interior material may automatically seal the access slot, thereby preventing weights from sliding or falling out of the pouch. The first and second sides of the access slot may be pressed together by the elastic interior material. The sides of the access slot may be the elastic interior material or may be a cover material, such as plastic or fabric, that is configured over the interior material along the access slot.

An exemplary adjustable weight exercise ball may be configured to receive any suitable type of weight, or weight unit. In a preferred embodiment, the weight units are discrete bags filled with a conformable material, such as water or sand, or another granulated type of material. A preferred weight unit will conform to the interior volume of the pouch. A discrete weight for insertion into the exercise ball may be about 0.5 kg or more, about 1.0 kg or more, about 2.0 kg or more, about 5 kg or more and any range between and including the weight values provided.

The summary of the invention is provided as a general introduction to some of the embodiments of the invention, and is not intended to be limiting. Additional example embodiments including variations and alternative configurations of the invention are provided herein.

BRIEF DESCRIPTION OF THE DRAWINGS

The accompanying drawings are included to provide a further understanding of the invention and are incorporated in and constitute a part of this specification, illustrate embodiments of the invention, and together with the description serve to explain the principles of the invention.

DETAILED DESCRIPTION OF THE ILLUSTRATED EMBODIMENTS

Figure 1:
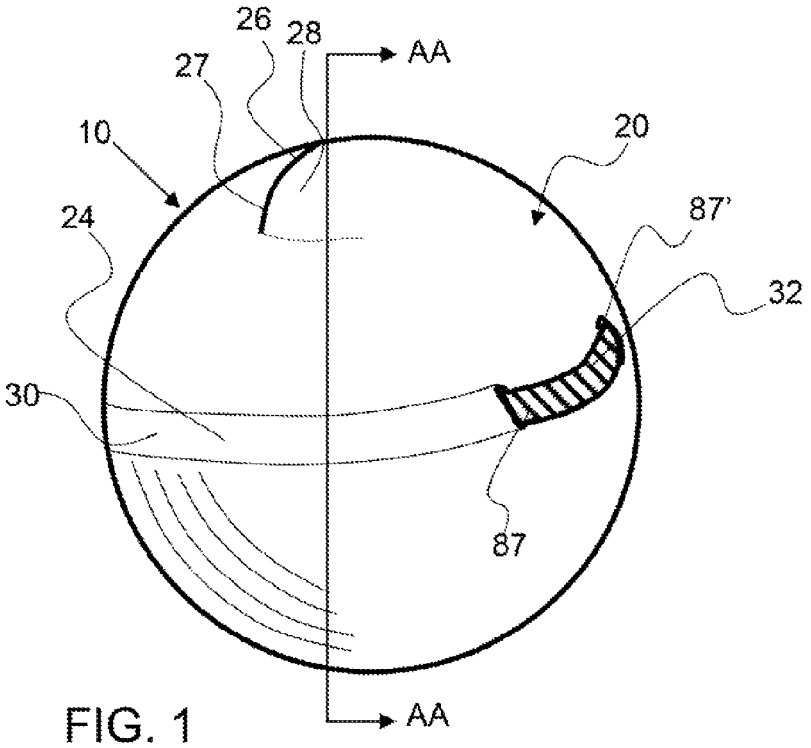

FIG. 1 shows an isometric view of an exemplary adjustable weight exercise ball having a strap extending around the perimeter of the ball with a portion of the strap configured within a sleeve and a portion exposed to form a handle.

Figure 2A:
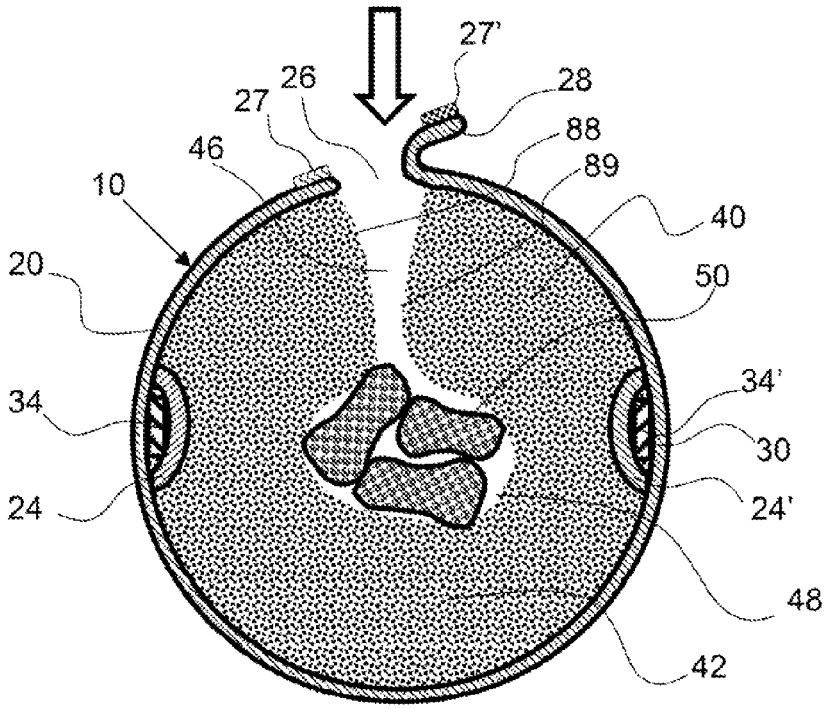

FIG. 2A shows a cross-sectional view of the exemplary adjustable weight exercise ball shown in FIG. 1 along line AA having an aperture in the outer cover for the placement of weights in a pouch configured substantially centered within the interior volume of the ball.

Figure 2B:
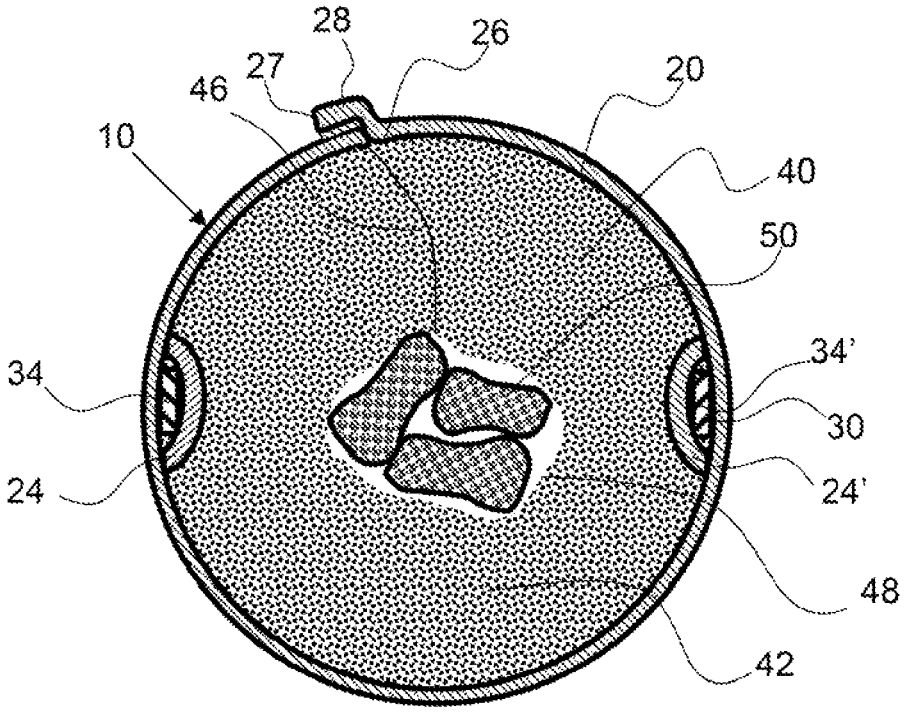

FIG. 2B shows a cross-sectional view of the exemplary adjustable weight exercise ball shown in FIG. 1 along line AA having an access slot that is substantially closed, having no open area as the elastic material has automatically closed the access slot.

Figure 3:
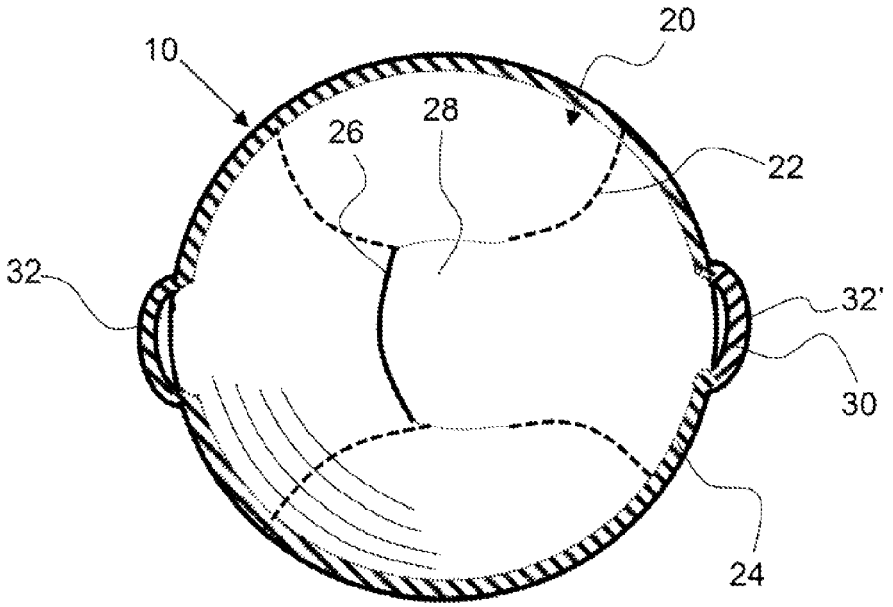

FIG. 3 shows a top-down view of an exemplary adjustable weight exercise ball having a first handle and a second handle configured on opposing sides of the ball.

Figure 4:
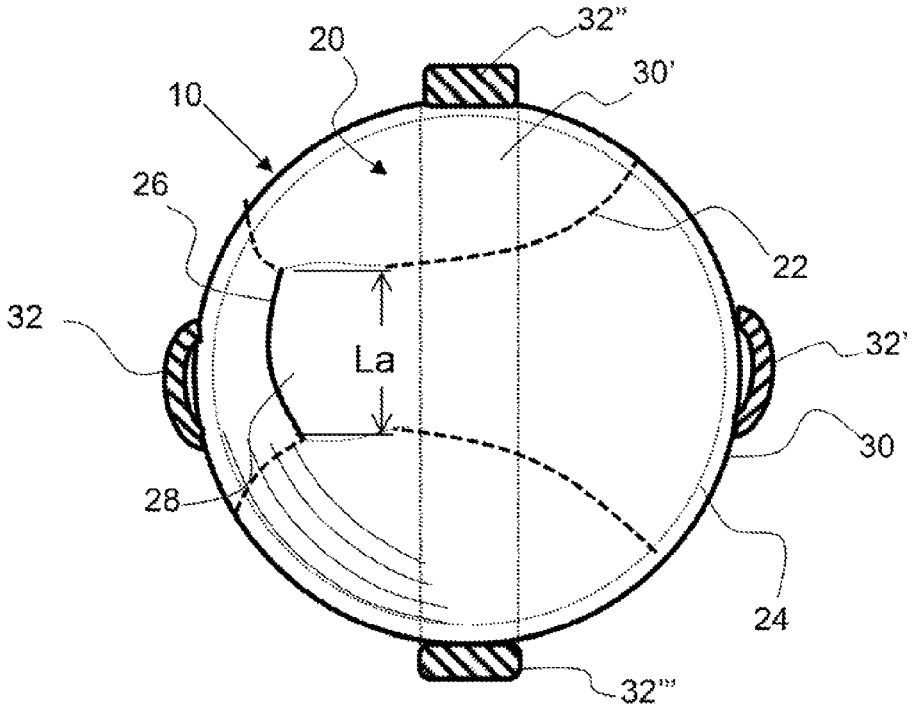

FIG. 4 shows a top-down view of an exemplary adjustable weight exercise ball having a strap forming two handles and a second strap forming two handles that are offset from the first strap handles.

Figure 5A:
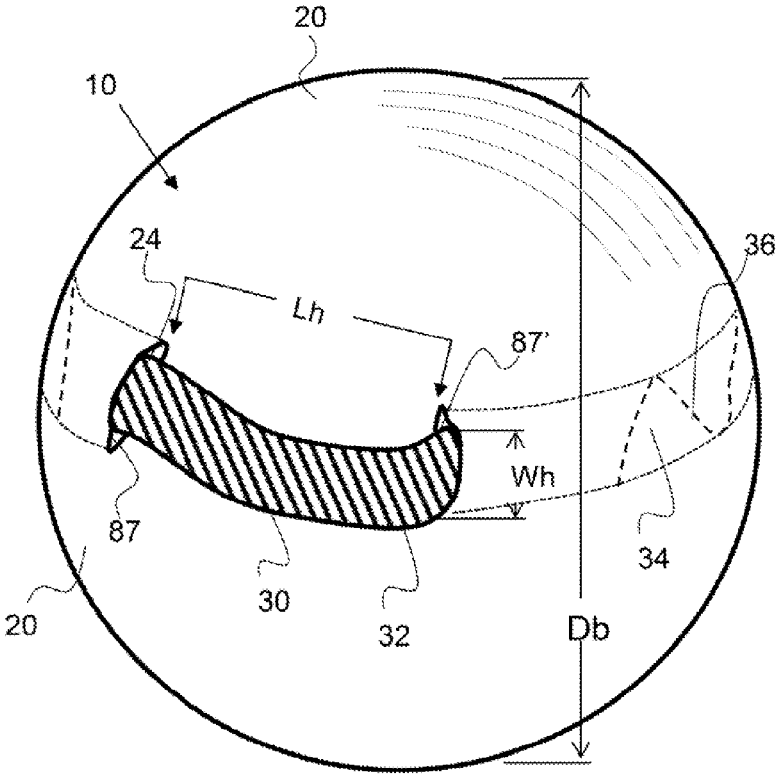

FIG. 5A shows an isometric view of an exemplary adjustable weight exercise ball having a strap extending around the ball within a sleeve, and a portion of the strap extending out from the inside of the outer cover to form a handle.

Figure 5B:
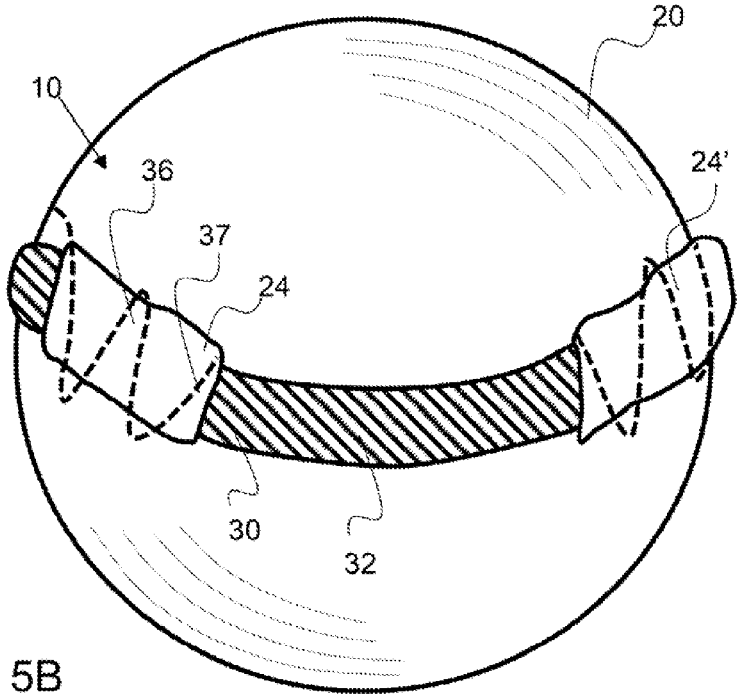

FIG. 5B shows an isometric view of an exemplary adjustable weight exercise ball having a strap extending around the exterior of the outer cover and retained in sleeves.

Figure 6:
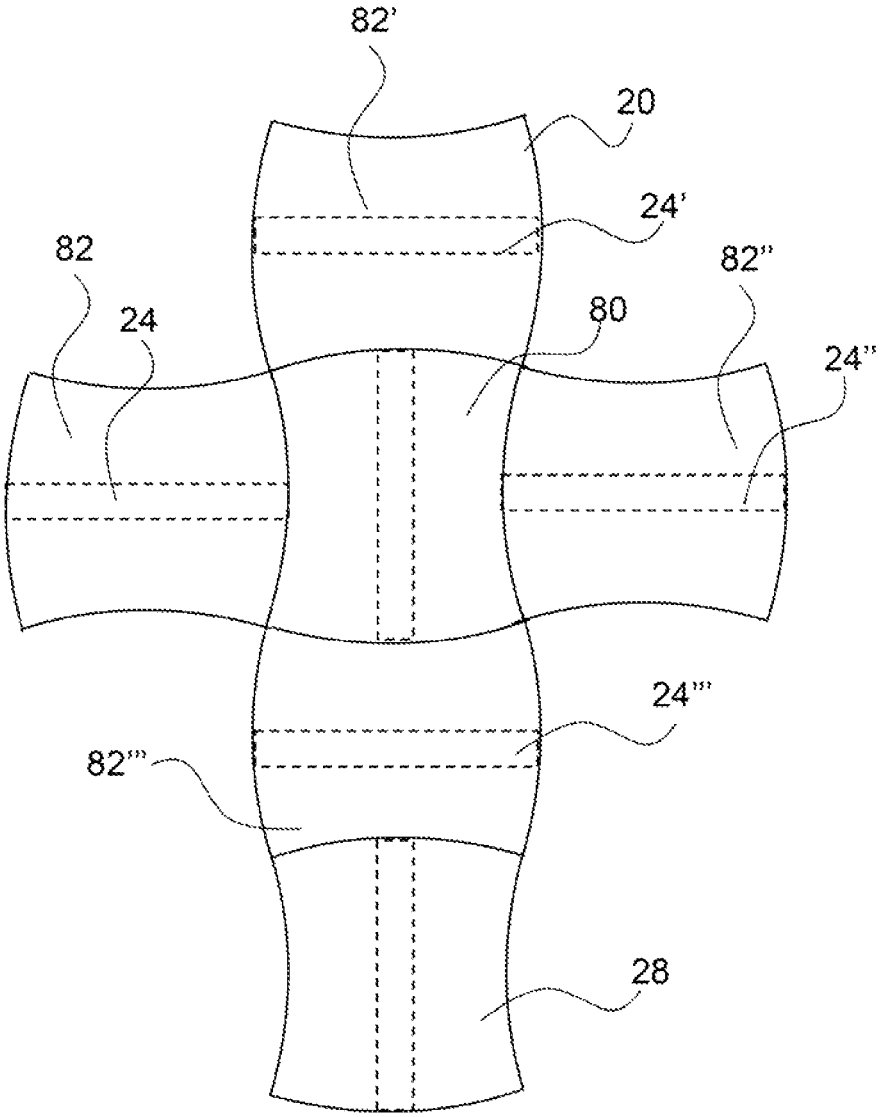

FIG. 6 shows a top-down view of an exemplary outer cover of the adjustable weight exercise ball.

Figure 7:
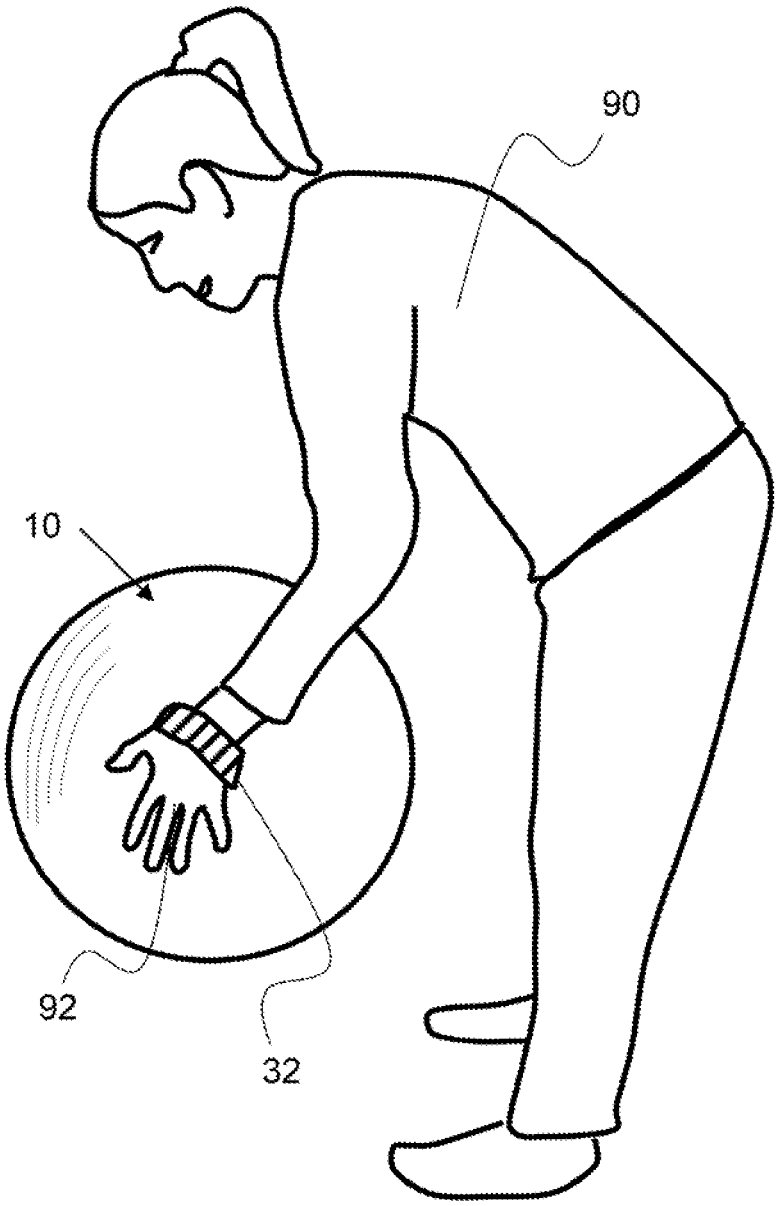

FIG. 7 shows a side view of a person holding an exemplary adjustable weight exercise ball with the handles pulled over their hands.

Figure 8:
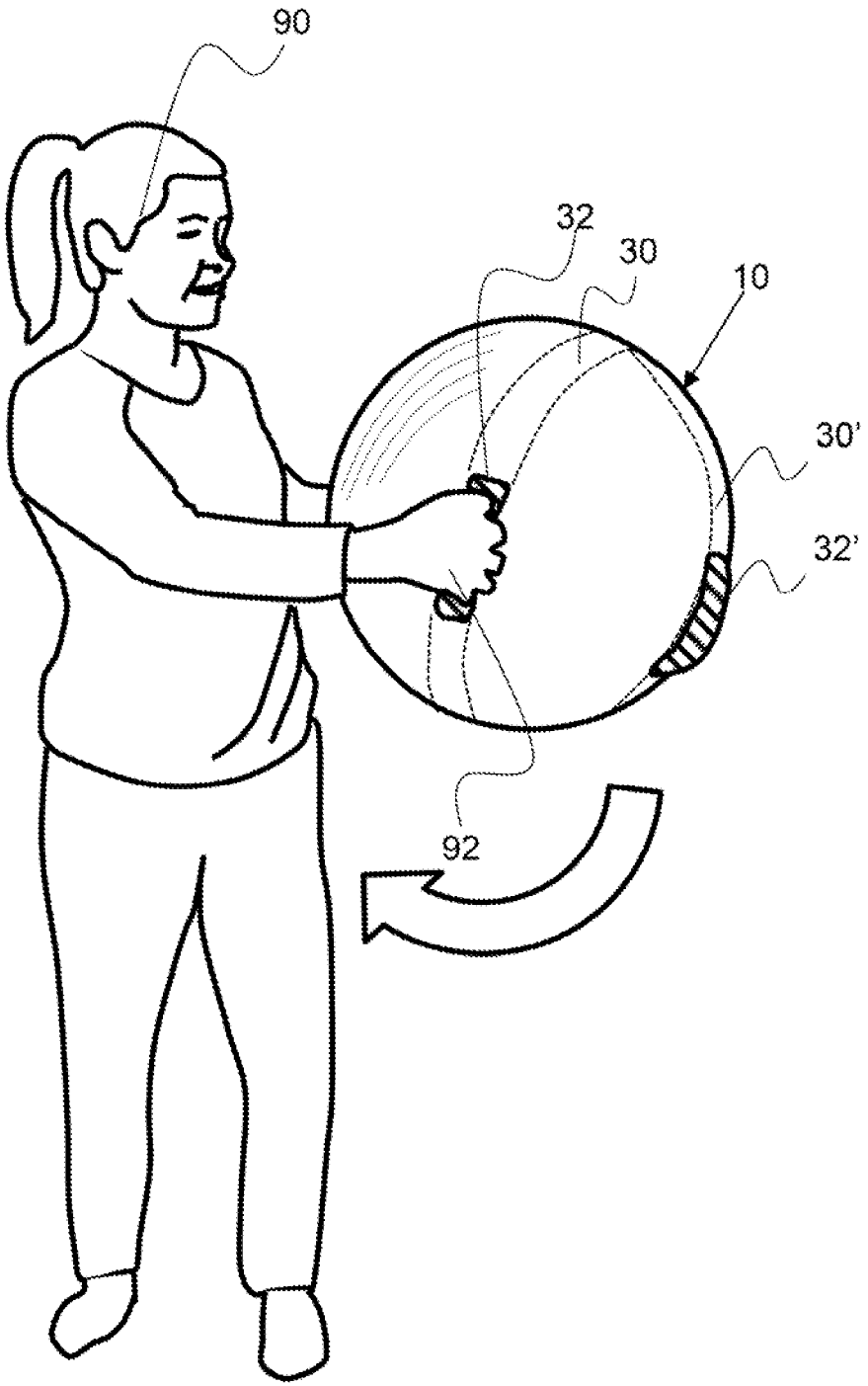

FIG. 8 shows a front view of a person grasping an exemplary adjustable weight exercise ball by the handles while twisting.

Figure 9:
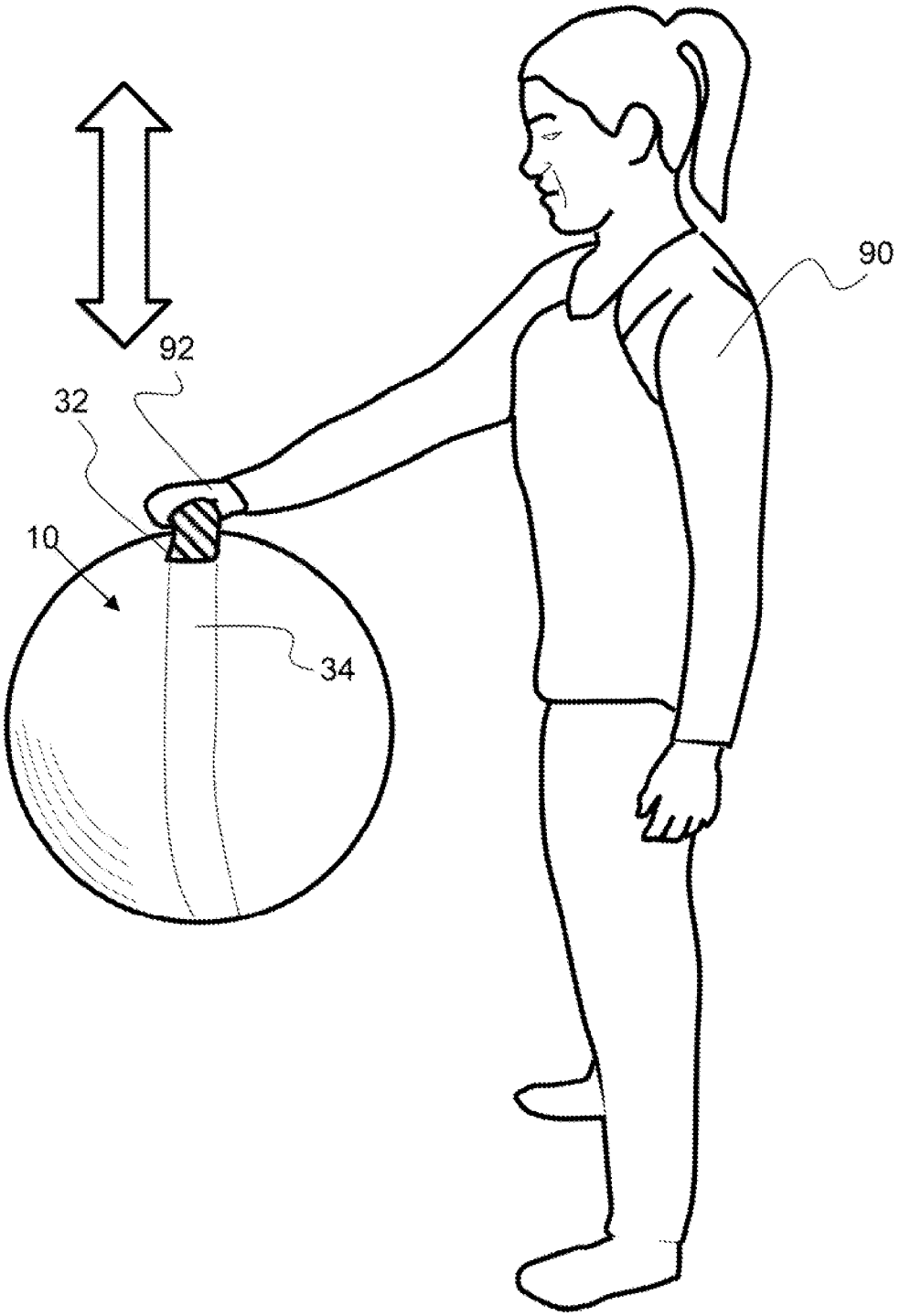

FIG. 9 shows a side view of a person grasping an exemplary adjustable weight exercise ball by the handle with one hand while lifting the ball.

Figure 10:
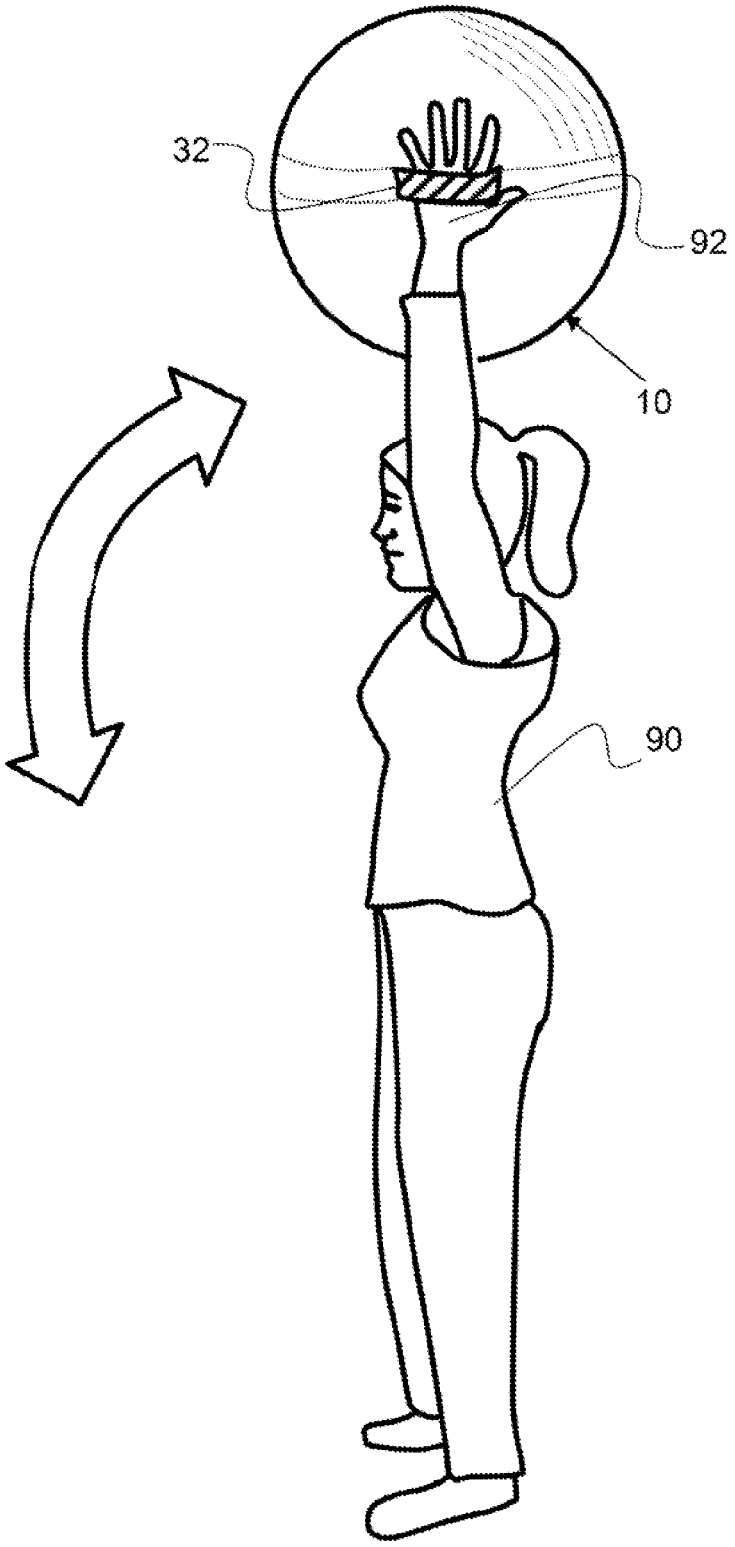

FIG. 10 shows a side view of a person holding an exemplary adjustable weight exercise ball with the handles pulled over their hands while lifting the ball over their head.

Corresponding reference characters indicate corresponding parts throughout the several views of the figures. The figures represent an illustration of some of the embodiments of the present invention and are not to be construed as limiting the scope of the invention in any manner. Further, the figures are not necessarily to scale, some features may be exaggerated to show details of particular components. Therefore, specific structural and functional details disclosed herein are not to be interpreted as limiting, but merely as a representative basis for teaching one skilled in the art to variously employ the present invention.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Also, use of "a" or "an" are employed to describe elements and components described herein. This is done merely for convenience and to give a general sense of the scope of the invention. This description should be read to include one or at least one and the singular also includes the plural unless it is obvious that it is meant otherwise.

Certain exemplary embodiments of the present invention are described herein and illustrated in the accompanying figures. The embodiments described are only for purposes of illustrating the present invention and should not be interpreted as limiting the scope of the invention. Other embodiments of the invention, and certain modifications, combinations and improvements of the described embodiments, will occur to those skilled in the art and all such alternate embodiments, combinations, modifications, improvements are within the scope of the present invention.

As shown in FIG. 1, an exemplary adjustable weight exercise ball 10 has a strap 30 extending around the perimeter of the ball in a sleeve 24 and a portion of the strap exposed to form a handle 32. The sleeve may be attached to the cover of the exercise ball and a contiguous strap may move freely within the sleeve. The sleeve extends around the perimeter of the ball on the inside of the outer cover 20. The strap extends from the interior of the exercise ball through openings 87, 87' in the outer cover to produce a handles. An aperture 26 is formed in the outer cover 20 of the adjustable weight exercise ball 10 for inserting weights. A flap 28 extends over the aperture. In another embodiment, the sleeve and strap retained therein are attached to the cover of the exercise ball. In still another embodiment, the strap is attached to the sleeve and the sleeve is attached to the cover.

As shown in FIG. 2A, the exemplary adjustable weight exercise ball 10 shown in FIG. 1 has an aperture 26 in the outer cover 20 for the insertion and removal of weights 50 in a pouch 48 configured substantially centered within the interior volume 42 of the ball. An access slot 46 extends between the aperture 26 and the pouch 48. The first side of the access slot 88 is separated from the second side of the access slot 89, thereby creating a continuous path from the aperture 26 to the pouch 48. Three discrete weight bags 50 are shown in the pouch. The weights may be any suitable type of weight, including rubber, metal, liquid or granular material filled bags or sacks. A weight may be a bladder that can be filled with liquid or a granular material such as sand. In a preferred embodiment, the weights are discrete weights as shown, and are non-rigid, or conformable, whereby the weight can conform readily to an external force exerted on the exterior of the weight, such as a bag filled with sand or water. This type of weight may more readily conform to the pouch and provide a safer exercise ball, as the weights are not hard and rigid. The interior material 40 of the exercise ball may be an elastomeric material, such as a foam, for example, that can be deformed to allow access to the pouch through the access slot, but that compresses together to effectively seal the access slot to retain the weights within the pouch.

Also shown in FIG. 2A is a flap 28 having one part of an aperture closure feature 27', such as a hook and loop fastener. The second part of the aperture closure feature 27 is shown being configured on the exterior of the exercise ball 10. Any suitable type of aperture closure feature may be used however, including a zipper, buttons, snaps and the like. A flap may extended completely over the aperture and overlap with a portion of the outer cover to completely enclose the aperture. The aperture closure features may be configured on the overlapping portion of the flap, as shown in FIG. 2A. A strap 30 is shown in FIG. 2A extending around the perimeter of the adjustable weight exercise ball 10 within a sleeve 24. The sleeve may extend any suitable portion of the perimeter of the ball, and may comprise a plurality of discrete sleeves to hold the strap along the interior or exterior of the outer cover 20 of the adjustable weight exercise ball.

As shown in FIG. 2B the exemplary adjustable weight exercise ball 10 shown in FIG. 1 has the flap 28 closed over the aperture 26 and the access slot 46 substantially closed, having no continuous opening between the pouch 48 and the outer cover 20. The elastic interior material 40 has automatically closed off the access slot, thereby retaining the weighs within the pouch. The first side of the access slot 88 is now contacting the second side of the access slot 89. The sides of the access slot consists essentially of the interior material 40.

As shown in FIG. 3, an exemplary adjustable weight exercise ball 10 has a first handle 32 and a second handle 32' configured on opposing sides of the ball, or approximately 180 degrees apart. An adjustable weight exercise ball may have any suitable number of handles and a single strap 30 extending around the perimeter of the ball may have one, two, three, four or more handle portions, or exposed strap areas. As shown in FIG. 3 the strap 30 is a continuous strap that extends around the entire perimeter or circumference of the exercise ball. In addition, the strap is a contiguous strap having no end.

As shown in FIG. 4, an exemplary adjustable weight exercise ball 10 has a first strap 30 forming two handles 32, 32' and a second strap 30' forming two handles 32", 32'" that are offset from the first strap handles. The first strap is configured at a 90 degree offset to the second strap. Put another way, the first strap is in the plane of the figure, and the second strap extends perpendicularly to the first strap. Note that the orientation of the aperture 26 is offset from the straps. The first and second continuous straps comprise two handles configured substantially opposing each other on the perimeter of the exercise ball and the handles formed from the first continuous strap are offset 90 degrees from the handles formed in the second continuous strap. In this particular embodiment, there are four handles formed around the circumference of the exercise ball. Put another way, the exercise ball could be cross-sectioned and four handles would be included in the cross-section. The two straps shown extend around the diameter of the exercise ball or the largest dimension of the exercise ball.

As shown in FIG. 5A, an exemplary adjustable weight exercise ball 10 has a strap 30 extending around the ball within a sleeve 24, and a portion of the strap extending out from the inside of the outer cover 20 to form a handle 32. The recessed portion of the strap 34, or portion that extends under the outer cover 20, may be secured to the outer cover by any suitable type of strap attachment 36, such as stitching, as shown, fasteners and the like. The length of the handle Lh, and width Wh, are shown in FIG. 5A. The strap extends through openings 87,87', such as slits, in the outer cover to form the handle 32. The diameter, Db, of the adjustable weight exercise ball 10 is also shown in FIG. 5A and may be any suitable diameter, as described herein. A strap may extend under the outer cover along a portion of the perimeter of the exercise ball and be secured directly to the outer cover, whereby the strap is not retained within a sleeve within the interior of the outer cover.

As shown in FIG. 5B, an exemplary adjustable weight exercise ball 10 has a strap 30 extending around the exterior of the outer cover 20 and is retained in a plurality of sleeves 24, 24' formed between a sleeve material and the outer cover 20. The sleeves are attached to the outer cover 20 by stitching 37, a type of a strap attachment 36. A sleeve material may be different than the material of the outer cover and may be heavier material, thereby providing more durability of attachment of the strap to the outer cover.

As shown in FIG. 6, an exemplary outer cover 20 of an adjustable weight exercise ball has a center portion 80 and four extensions 82-82'". Each extension may be attached to adjacent extensions to form a sphere or ball. One extension may comprise an additional length of material that will form a flap 28, over an aperture. Sleeves 24 may be configured on the interior or exterior of the outer cover prior to assembly of the adjustable weight exercise ball 10.

As shown in FIG. 7, a person 90 is holding an exemplary adjustable weight exercise ball 10 with the handles 32 pulled over their hands 92. A person may grasp the handles or slide a handle over their hand as shown.

As shown in FIG. 8, a person 90 is grasping an exemplary adjustable weight exercise ball 10 by the handles 32 while twisting. The ball shown in FIG. 8 has two straps 30, 30'. In this embodiment, the two straps may form four handles each configured at 90 degree offsets from each other around the perimeter or circumference of the exercise ball.

As shown in FIG. 9, a person 90 is grasping an exemplary adjustable weight exercise ball 10 by the handle 32 with one hand 92 while lifting the ball. The recessed portion of the strap 34 is shown in dashed lines extending around the perimeter of the ball inside the outer cover.

As shown in FIG. 10, a person 90 is holding an exemplary adjustable weight exercise 10 ball with the handles 32 pulled over their hands 92 while lifting the ball over their head.

DEFINITIONS

Smooth, as used herein, means a spherical shape with no protrusions from the outer surface extending more than 5% of the diameter of the sphere.

Conformable weight units, as used herein, is defined as a weight unit that comprises a malleable type of material, whereby the weight unit will readily change shape as a function of an force exerted thereon, such as gravity, wherein the weight will flow or conform to a support surface with gravity. A conformable weight unit may comprise a material that flows, such as water or sand for example, within a flexible enclosure, such as a bag.

Conformable adjustable weight exercise ball, as used herein, is defined as an exercise ball that can conform readily to an external force exerted on the exterior or outer cover of the exercise ball, wherein the exercise ball may have an interior material that is soft and deformable such as a polymeric foam. A conformable adjustable weight exercise ball may be soft, as described herein.

Soft, as used to describe the exercise ball, means that the adjustable weight exercise ball has a shore-A durometer of no more than about 50, and preferably no more than about 35 shore-A.

It will be apparent to those skilled in the art that various modifications, combinations and variations can be made in the present invention without departing from the spirit or scope of the invention. Specific embodiments, features and elements described herein may be modified, and/or combined in any suitable manner. Thus, it is intended that the present invention cover the modifications, combinations and variations of this invention provided they come within the scope of the appended claims and their equivalents.

What is claimed is:

1. An adjustable weight exercise ball comprising:

a. a generally spherical and smooth outer surface having a perimeter;

b. an outer covering comprising i. a single aperture;

c. a first continuous strap that extends around said perimeter comprising:

i. a first exposed handle; and ii. a second exposed handle configured 180 degrees around the perimeter of the exercise ball;

wherein the first continuous strap is configured under the outer covering except where it extends out through the outer covering to form said first and second handles;

d. an interior volume comprising:

i. an interior material that is an elastic compressible material having an access slot that is aligned with said single aperture in the outer covering;

ii. a pouch substantially centered within said interior volume and substantially surrounded by said compressible material, wherein the pouch does not extend to the outer covering and wherein the pouch is coupled with the access slot;

wherein the pouch extends radially out from the access slot and has a pouch volume that is no more than 30% of the exercise ball volume as defined by the exercise ball diameter;

wherein the access slot extends only from the perimeter of the outer surface to said pouch;

wherein the access slot is automatically closed by the elastic compressible material when not being forced open to produce an access slot that is substantially closed, having no open area;

e. a plurality of conformable weight units whereby said plurality of conformable weight units are configured for insertion through said single aperture, through said access slot and into said pouch to adjust a weight of said exercise ball, and wherein said exercise ball is soft.

2. The adjustable weight exercise ball of claim 1, wherein the first strap is a contiguous strap.

3. The adjustable weight exercise ball of claim 1, wherein the first continuous strap comprises recessed portions that are configured within a sleeve that is configured under the outer covering, and whereby the sleeve is attached to the outer covering.

4. The adjustable weight exercise ball of claim 3, wherein the continuous strap is attached to the sleeve.

5. The adjustable weight exercise ball of claim 1, wherein the exercise ball has an outer diameter of 30 cm or more.

6. The adjustable weight exercise ball of claim 1, wherein the exercise ball has an outer diameter of 100 cm or more.

7. The adjustable weight exercise ball of claim 1, wherein the single aperture is no more than 15 cm in length.

8. The adjustable weight exercise ball of claim 1, further comprising an aperture closure feature.

9. The adjustable weight exercise ball of claim 8, wherein the aperture closure feature comprises a zipper.

10. The adjustable weight exercise ball of claim 8, wherein the aperture closure feature comprises a hook and loop fastener.

11. The adjustable weight exercise ball of claim 8, wherein the aperture closure feature comprises an overlapping flap.

12. The adjustable weight exercise ball of claim 1, wherein the first continuous strap has a width of no more than 7.5 cm.

13. The adjustable weight exercise ball of claim 1, comprising a second continuous strap that extends around said perimeter comprising:

i. a first exposed handle; and ii. a second exposed handle configured 180 degrees around the perimeter of the exercise ball;

wherein said second continuous strap is configured under the outer covering except where it extends out through the outer covering to form said first and second handles.

14. The adjustable weight exercise ball of claim 13, wherein the first and second handles of said first continuous strap are offset 90 degrees from the first and second handles of the second continuous strap, thereby forming four handles around a circumference of said adjustable weight exercise ball.

15. The adjustable weight exercise ball of claim 1, wherein the pouch comprises no more than 20% of an exercise ball volume.

16. The adjustable weight exercise ball of claim 1, wherein the compressible material is an elastic material.

17. The adjustable weight exercise ball of claim 1, wherein the interior material is a high density foam.

18. The adjustable weight exercise ball of claim 1, wherein the conformable weight units comprise a granular material within a flexible enclosure.

19. The adjustable weight exercise ball of claim 1, wherein the conformable weight units comprise a granular material within a fabric enclosure.

* * * * *